US009142925B2

(12) United States Patent
Golko et al.

(10) Patent No.: US 9,142,925 B2
(45) Date of Patent: Sep. 22, 2015

(54) D-SHAPED CONNECTOR

(75) Inventors: Albert J. Golko, Saratoga, CA (US); Mathias W. Schmidt, Mountain View, CA (US); Eric S. Jol, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 13/700,664

(22) PCT Filed: May 27, 2011

(86) PCT No.: PCT/US2011/038451

§ 371 (c)(1), (2), (4) Date: Nov. 28, 2012

(87) PCT Pub. No.: WO2011/150402

PCT Pub. Date: Dec. 1, 2011

(65) Prior Publication Data

US 2013/0078869 A1 Mar. 28, 2013

Related U.S. Application Data

(60) Provisional application No. 61/349,737, filed on May 28, 2010, provisional application No. 61/353,126, filed on Jun. 9, 2010, provisional application No. 61/356,499, filed on Jun. 18, 2010.

(51) Int. Cl.
*H01R 24/58* (2011.01)
*H01R 13/642* (2006.01)
(Continued)

(52) U.S. Cl.
CPC ..... *H01R 24/58* (2013.01); *H01R 13/05* (2013.01); *H01R 13/642* (2013.01); *H01R 24/86* (2013.01); *H01R 13/562* (2013.01); *H01R 2107/00* (2013.01)

(58) Field of Classification Search
USPC ..... 439/668, 669, 661, 908
See application file for complete search history.

(56) References Cited

U.S. PATENT DOCUMENTS 2,792,557 A 5/1957 Dowick
2,892,990 A 6/1959 Werndl
(Continued)

FOREIGN PATENT DOCUMENTS

DE 196 09 571 A1 11/1995
DE 20 2004 021354 U1 9/2007
(Continued)

OTHER PUBLICATIONS

Flipper Press Release (Jun. 25, 2012) and Data Sheet: http://www.flipperusb.com/images/flipperUSB-brochure.pdf, http://www.flipperusb.com/images/flipperUSB-brochure.pdf.
(Continued)

*Primary Examiner* — Alexander Gilman
(74) *Attorney, Agent, or Firm* — Kilpatrick Townsend & Stockton LLP

(57) ABSTRACT

The present disclosure relates generally to connector plugs and jacks and in particular to an audio connector plug and jack that can be used in place of the a standard low profile plug and electronic devices using low profile plug receptacles. The connector plug has a reduced plug length and thickness, an intuitive insertion orientation and a smooth, consistent feel when inserted and extracted from its corresponding receptacle connector. A portion or all of the plug connector may include a flexible material that allows the connector to bend with respect to an insertion axis along which the plug connector is designed to be inserted into a corresponding receptacle connector. A corresponding connector jack may be configured to receive the reduced length and thickness connector plug.

22 Claims, 7 Drawing Sheets

(51) Int. Cl.

| | |
|---|---|
| ***H01R 13/05*** | (2006.01) |
| ***H01R 24/86*** | (2011.01) |
| *H01R 107/00* | (2006.01) |
| *H01R 13/56* | (2006.01) |

(56) References Cited

U.S. PATENT DOCUMENTS

| | | | | |
|---|---|---|---|---|
| 3,793,614 | A | 2/1974 | Tachick et al. | |
| 3,795,037 | A | 3/1974 | Luttmer | |
| 4,361,375 | A | 11/1982 | Bailey et al. | |
| 4,621,882 | A | 11/1986 | Krumme | |
| 4,711,506 | A | 12/1987 | Tanaka | |
| 5,256,074 | A | 10/1993 | Tan | |
| 5,387,110 | A | 2/1995 | Kantner et al. | |
| 5,442,243 | A | 8/1995 | Bailey | |
| 5,967,833 | A | 10/1999 | Cachina | |
| 6,074,225 | A | 6/2000 | Wu et al. | |
| 6,179,627 | B1 | 1/2001 | Daly et al. | |
| 6,309,255 | B1 | 10/2001 | Yu | |
| 6,364,699 | B1 | 4/2002 | Hwang et al. | |
| 6,410,857 | B1 | 6/2002 | Gonya | |
| 6,533,617 | B1 * | 3/2003 | D'Addario | 439/669 |
| 6,869,320 | B2 | 3/2005 | Haas et al. | |
| 6,981,887 | B1 | 1/2006 | Mese et al. | |
| 7,094,089 | B2 | 8/2006 | Andre et al. | |
| 7,115,124 | B1 | 10/2006 | Xiao | |
| 7,198,522 | B1 | 4/2007 | Ho et al. | |
| 7,361,059 | B2 | 4/2008 | Harkabi et al. | |
| 7,407,416 | B1 * | 8/2008 | Rogers et al. | 439/669 |
| 7,435,107 | B2 | 10/2008 | Matsumoto et al. | |
| 7,442,091 | B2 | 10/2008 | Salomon et al. | |
| 7,458,825 | B2 | 12/2008 | Atsmon et al. | |
| 7,500,861 | B2 | 3/2009 | Harkabi et al. | |
| 7,716,400 | B2 | 5/2010 | Raines | |
| 7,717,717 | B1 | 5/2010 | Lai | |
| 7,854,633 | B2 | 12/2010 | Lynch et al. | |
| 7,918,685 | B1 | 4/2011 | Kruckenberg | |
| 8,317,527 | B2 * | 11/2012 | Vitale | 439/103 |
| 8,698,699 | B2 * | 4/2014 | Saarela et al. | 343/906 |
| 2002/0025729 | A1 | 2/2002 | D'Addario | |
| 2003/0016509 | A1 | 1/2003 | Tsukamoto | |
| 2004/0215966 | A1 | 10/2004 | Elteto | |
| 2004/0229515 | A1 | 11/2004 | Kaneda et al. | |
| 2005/0085136 | A1 | 4/2005 | Zhang | |
| 2005/0202727 | A1 | 9/2005 | Andre et al. | |
| 2006/0024997 | A1 | 2/2006 | Teicher | |
| 2006/0289201 | A1 | 12/2006 | Kim et al. | |
| 2007/0037452 | A1 | 2/2007 | Martin et al. | |
| 2007/0072442 | A1 | 3/2007 | DiFonzo | |
| 2007/0082701 | A1 | 4/2007 | Seil et al. | |
| 2007/0178771 | A1 | 8/2007 | Goetz et al. | |
| 2007/0243726 | A1 | 10/2007 | Trenne | |
| 2008/0032562 | A1 * | 2/2008 | McHugh et al. | 439/668 |
| 2008/0090465 | A1 * | 4/2008 | Matsumoto et al. | 439/669 |
| 2008/0119076 | A1 | 5/2008 | Teicher | |
| 2008/0167828 | A1 | 7/2008 | Terlizzi et al. | |
| 2008/0188137 | A1 * | 8/2008 | Goetz et al. | 439/669 |
| 2008/0274633 | A1 | 11/2008 | Teicher | |
| 2009/0004923 | A1 | 1/2009 | Tang et al. | |
| 2009/0081906 | A1 | 3/2009 | Lynch et al. | |
| 2009/0108848 | A1 | 4/2009 | Lundquist | |
| 2009/0117768 | A1 | 5/2009 | Liao | |
| 2009/0156027 | A1 | 6/2009 | Chen | |
| 2009/0180243 | A1 | 7/2009 | Lynch et al. | |
| 2009/0185707 | A1 | 7/2009 | Smith | |
| 2009/0196553 | A1 | 8/2009 | Anderson et al. | |
| 2010/0009575 | A1 * | 1/2010 | Crooijmans et al. | 439/668 |
| 2010/0062656 | A1 | 3/2010 | Lynch et al. | |
| 2010/0087099 | A1 * | 4/2010 | Fadell et al. | 439/669 |
| 2010/0104126 | A1 | 4/2010 | Greene | |
| 2010/0190382 | A1 | 7/2010 | Szini | |
| 2010/0201602 | A1 * | 8/2010 | Saarela et al. | 343/906 |
| 2010/0208631 | A1 | 8/2010 | Zhang et al. | |
| 2011/0059649 | A1 | 3/2011 | Montena | |
| 2011/0250786 | A1 | 10/2011 | Reid | |
| 2011/0269352 | A1 * | 11/2011 | Vitale | 439/661 |
| 2012/0220148 | A1 * | 8/2012 | Walls, Jr. | 439/218 |
| 2013/0210286 | A1 | 8/2013 | Golko et al. | |

FOREIGN PATENT DOCUMENTS

| | | | |
|---|---|---|---|
| DE | 202007009637 | U1 | 11/2007 |
| EP | 0081372 | A2 | 6/1983 |
| EP | 1898499 | A2 | 3/2008 |
| FR | 2138961 | A1 | 1/1973 |
| JP | 2 078171 | A | 3/1990 |
| JP | 2003-217728 | A | 7/2003 |
| JP | 2004 079491 | A | 3/2004 |
| WO | 2004/097995 | A1 | 11/2004 |
| WO | 2005/013436 | A1 | 2/2005 |
| WO | 2006/013553 | A2 | 2/2006 |
| WO | 2006/074348 | A1 | 12/2006 |
| WO | 2008/065659 | A2 | 6/2008 |
| WO | 2008076925 | A2 | 6/2008 |
| WO | 2009/069969 | A2 | 6/2009 |
| WO | 2009/140992 | A1 | 11/2009 |

OTHER PUBLICATIONS

International Search Report for International PCT Application No. PCT/US2011/038452, mailed on Oct. 26, 2011, 7 pages.

International Search Report and Written Opinion for International PCT Application No. PCT/US2011/041286, mailed on Oct. 20, 2011, 18 pages.

International Search Report and Written Opinion for International PCT Application No. PCT/US2011/041127, mailed on Dec. 29, 2011, 17 pages.

International Search Report and Written Opinion for International PCT Application No. PCT/US2011/041290, mailed on Nov. 21, 2011, 21 pages.

PCT Publication No. WO 2011/156653 A1, Pub. Date. Dec. 15, 2011 for Application No. PCT/US2011/039870 and International Search Report; Oct. 4, 2011, 27 pages.

International Preliminary Report on Patentability for PCT/US2011/039870; Mailed Dec. 20, 2012, 8 pages.

International Search Report and Written Opinion; PCT/US2011/038451; mailed Sep. 15, 2011, 13 pages.

Notice of Allowance for U.S. Appl. No. 13/703,000, mailed Apr. 24, 2015, 7 pages.

International Preliminary Report on Patentability for International PCT Application No. PCT/US2011/038451, mailed Dec. 4, 2012, 7 pages.

Written Opinion for PCT Application No. PCT/US2011/039870, mailed Oct. 4, 2011, 6 pages.

Office Action for Korean Application No. 10-2012-7034041, mailed Jun. 13, 2014, 14 pages.

Office Action for Chinese Application No. 201180028048.8, mailed Sep. 28, 2014, 18 pages.

Extended European Search Report, EP App. No. 11793200.4, mailed Nov. 11, 2014, 9 pages.

Extended European Search Report, EP App. No. 11787546.8, mailed Nov. 17, 2014, 9 pages.

Non-Final Office Action for U.S. Appl. No. 13/703,000, mailed Jan. 13, 2015, 8 pages.

* cited by examiner

D-SHAPED CONNECTOR

CROSS-REFERENCES TO RELATED APPLICATIONS

This application is a U.S. National Stage Application of PCT/US2011/038451, filed May 27, 2011, which claims the benefit of U.S. Provisional Patent Applications No. 61/349,737, filed May 28, 2010; 61/353,126, filed Jun. 9, 2010; and 61/356,499, filed Jun. 18, 2010, each of which is hereby incorporated by reference herein in its entirety.

BACKGROUND OF THE INVENTION

The present invention relates generally to connectors such as audio jacks and in particular to an audio connector that can be used in place of the a standard low profile plug receptacles and electronic devices using low profile plug receptacles.

Standard audio connectors or plugs are available in three sizes according to the outside diameter of the plug: a 6.35 mm (¼") plug, a 3.5 mm (⅛") miniature plug and a 2.5 mm (3/32") subminiature plug. The plugs include multiple conductive regions that extend along the length of the connectors in distinct portions of the plug such as the tip, sleeve and one or more middle portions between the tip and sleeve resulting in the connectors often being referred to as TRS (tip, ring and sleeve) connectors.

FIGS. 1A and 1B illustrate examples of audio plugs 10 and 20 having three and four conductive portions, respectfully. As shown in FIG. 1A, plug 10 includes a conductive tip 12, a conductive sleeve 14 and a conductive ring 16 electrically isolated from the tip 12 and the sleeve 14 by insulating rings 17 and 18. The three conductive portions 12, 14, and 16 are for left and right audio channels and a ground connection. Plug 20, shown in FIG. 1B, includes four conductive portions: a conductive tip 22, a conductive sleeve 24 and two conductive rings 25 and 26 and is thus sometimes referred to as a TRRS (tip, ring, ring, sleeve) connector. The four conductive portions are electrically isolated by insulating rings 27, 28 and 29 and are typically used for left and right audio, microphone and ground signals.

When plugs 10 and 20 are 3.5 mm miniature connectors, the outer diameter of conductive sleeve 14 and 24 and conductive rings 16, 25, and 26 is 3.5 mm and the connector is 14 mm long, and for a 2.5 mm subminiature connector the outer diameter of the conductive sleeve is 2.5 mm and the connector is 11 mm long. Such TRS and TRRS connectors are used in many commercially available MP3 players and smart phones as well as other electronic devices. Electronic devices such as MP3 players and smart phones are continuously being designed to be thinner and smaller and/or to include video displays with screens that are pushed out as close to the outer edge of the devices as possible. The diameter and length of current 3.5 mm and even 2.5 mm audio connectors are limiting factors in making such devices smaller, thinner and allowing the displays to be larger.

Some manufacturers have used USB, mini-USB and micro-USB connectors as audio connectors to connect headphones and similar audio components to electronic devices. FIG. 2 is an example of a micro-USB connector 30, the smallest of the USB connectors. Connector 30 includes an outer housing 32 and a metallic shell 34 that is inserted into a corresponding receptacle connector. Shell 34 defines an interior cavity 38 and includes five contacts 36 formed within the cavity. The insertable shell portion 34 of connector 30 is both thinner and shorter than even the 2.5 mm subminiature version of connectors 10 and 20. Connector 30, however, suffers from other drawbacks that detract from the overall user experience. For example, connector 30 must be inserted into its respective receptacle connector in a particular orientation, yet it is difficult for the user to determine when connector 30 is oriented in the correct insertion position. Also, even when connector 30 is properly aligned, the insertion and extraction of the connector is not precise, has an inconsistent feel and, even when the connector is fully inserted, has an undesirable degree of wobble that may result in either a faulty connection or breakage. Additionally, cavity 38 is prone to collecting and trapping debris within the cavity which may interfere with the signal connections.

BRIEF SUMMARY OF THE INVENTION

In view of the shortcomings in currently available audio connectors as described above, the present invention provides an improved audio plug connector having a reduced plug length and thickness, an intuitive insertion orientation and a smooth, consistent feel when inserted and extracted from its corresponding receptacle connector. In some embodiments, a portion or all of the plug connector may include a flexible material that allows the connector to bend with respect to an insertion axis along which the plug connector is designed to be inserted into a corresponding receptacle connector. Additionally, audio plug connectors according to the present invention have external contacts instead of internal contacts and thus do not include a cavity that is prone to collecting and trapping debris.

In one embodiment, a plug connector according to the present invention includes a shell and a sleeve coupled to the shell at its base and having a D-shaped cross section. The sleeve has a ground contact at its distal tip, a plurality of contacts are arranged around a periphery of the sleeve and a plurality of dielectric strips that electrically isolate the plurality of contacts from each other. An insulation ring is positioned between the distal tip and the plurality of contacts and each of the plurality of contacts and plurality of dielectric strips extend from the insulation ring to the shell.

In another embodiment, a plug connector according to the present invention includes a flexible shell and a sleeve coupled to the shell at its base. The sleeve has a D-shaped cross section, a ground contact at its distal tip, a plurality of contacts arranged around a periphery of the sleeve, and a plurality of flexible dielectric strips that electrically isolate the plurality of contacts from each other and an insulation ring between the distal tip and the plurality of contacts and plurality of dielectric strips where each of the plurality of contacts and plurality of dielectric strips extend from the insulation ring to the shell.

In still another embodiment, a connector jack that can be used in conjunction with plug connectors according to the present invention includes a housing that defines an interior cavity into which a plug connector can be inserted. The cavity has a D-shaped cross-section, a ground contact at the rear portion and a plurality of contacts arranged around the walls of the interior cavity to match the locations of the contacts on a corresponding connector plug.

To better understand the nature and advantages of the present invention, reference should be made to the following description and the accompanying figures. It is to be understood, however, that each of the figures is provided for the purpose of illustration only and is not intended as a definition of the limits of the scope of the present invention.

BRIEF DESCRIPTION OF THE DRAWINGS

FIG. 2A shows a perspective view of a previously known micro-USB plug connector while

FIG. 6A is top view of the D-shaped connector according to embodiments of the invention wherein a flexible inner member is included while

FIG. 7A is a simplified perspective view of a connector jack that can be used in conjunction with plug connectors according to the present invention while

DETAILED DESCRIPTION OF THE INVENTION

Embodiments of the present invention pertain to connectors such as audio jacks and in particular to an audio connector that can be used in place of the a standard low profile plug receptacles and electronic devices using low profile plug receptacles. These connectors may be suitable for a multiplicity of electronic devices, including any device with audio out signals (e.g., radio, landline phone, stereo). In some embodiments, the invention is particularly well suited for portable electronic media devices because of its potentially small form factor.

As used herein, an electronic media device includes any device with at least one electronic component that may be used to present human-perceivable media. Such devices may include, for example, portable music players (e.g., Apple's iPod devices), portable video players (e.g., portable DVD players), cellular telephones (e.g., Apple's iPhone devices), video cameras, digital still cameras, projection systems (e.g., holographic projection systems), gaming systems, PDAs, desktop computers, as well as tablet or other mobile computers (e.g., Apple's iPad devices). Some of these devices may be configured to provide audio, video or other sensory output.

Figure 1A:
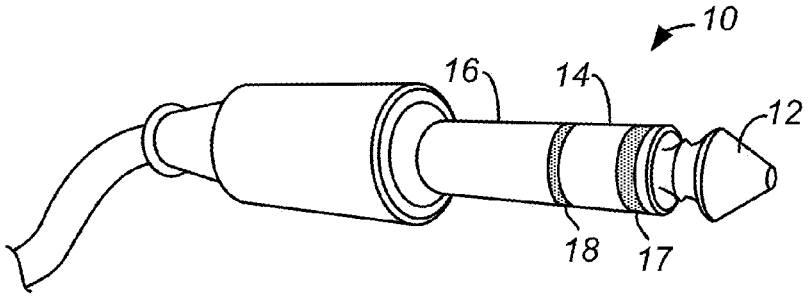
FIGS. 1A and 1B show perspective views of previously known TRS audio plug connectors.
Figure 1B:
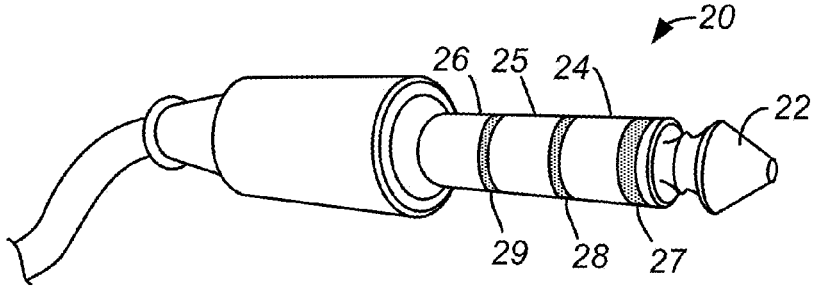
Figure 2A:
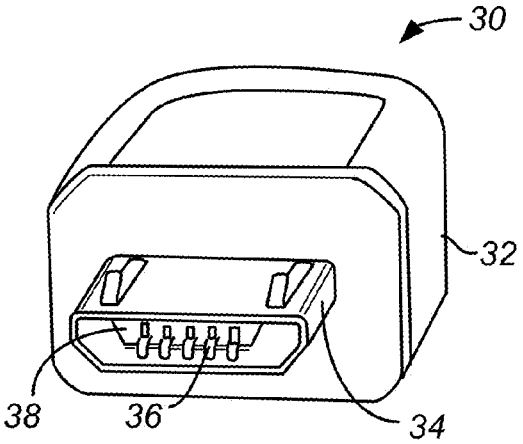
Figure 2B:
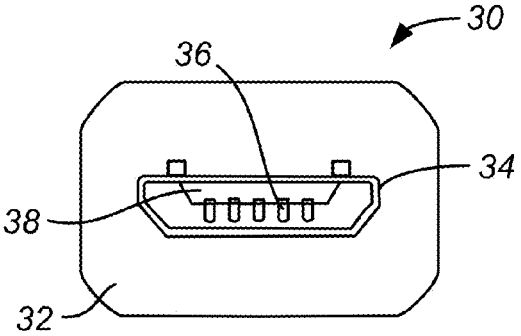
FIG. 2B shows a front plan view of the micro-USB connector shown in FIG. 2A.
Figure 3:
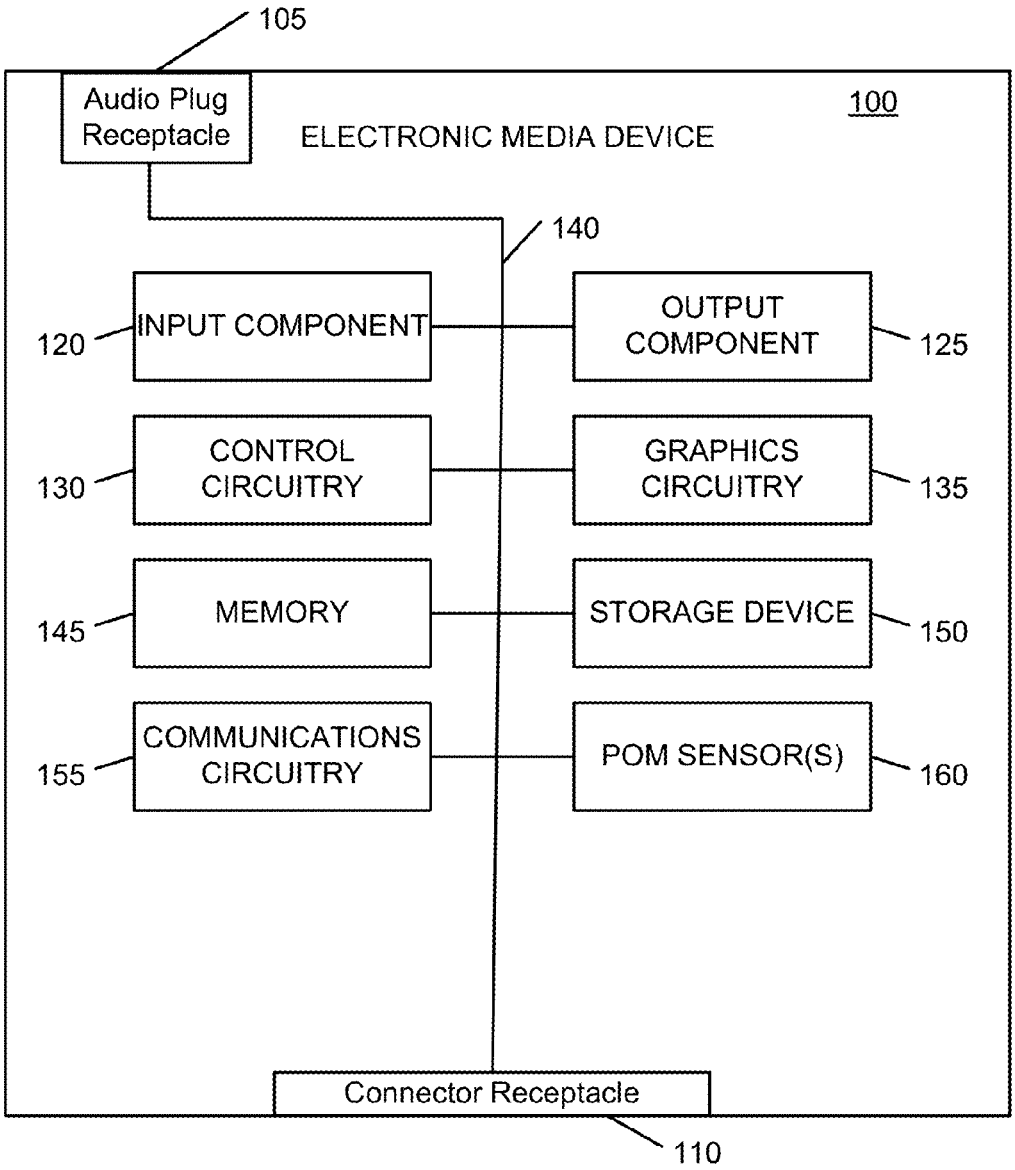
FIG. 3 is a simplified illustrative block diagram of an electronic media device suitable for use with embodiments of the present invention.

FIG. 3 is a simplified illustrative block diagram representing an electronic media device 100 that includes an audio plug receptacle 105 according to embodiments of the present. Electronic media device 100 may also include, among other components, connector receptacle 110, one or more user input components 120, one or more output components 125, control circuitry 130, graphics circuitry 135, a bus 140, a memory 145, a storage device 150, communications circuitry 155 and POM (position, orientation or movement sensor) sensors 160. Control circuitry 130 may communicate with the other components of electronic media device 100 (e.g., via bus 140) to control the operation of electronic media device 100. In some embodiments, control circuitry 130 may execute instructions stored in a memory 145. Control circuitry 130 may also be operative to control the performance of electronic media device 100. Control circuitry 130 may include, for example, a processor, a microcontroller and a bus (e.g., for sending instructions to the other components of electronic media device 100). In some embodiments, control circuitry 130 may also drive the display and process inputs received from input component 120.

Memory 145 may include one or more different types of memory that may be used to perform device functions. For example, memory 145 may include cache, flash memory, ROM, RAM and hybrid types of memory. Memory 145 may also store firmware for the device and its applications (e.g., operating system, user interface functions and processor functions). Storage device 150 may include one or more suitable storage mediums or mechanisms, such as a magnetic hard drive, flash drive, tape drive, optical drive, permanent memory (such as ROM), semi-permanent memory (such as RAM) or cache. Storage device 150 may be used for storing media (e.g., audio and video files), text, pictures, graphics, advertising or any suitable user-specific or global information that may be used by electronic media device 100. Storage device 150 may also store programs or applications that may run on control circuitry 130, may maintain files formatted to be read and edited by one or more of the applications and may store any additional files that may aid the operation of one or more applications (e.g., files with metadata). It should be understood that any of the information stored on storage device 150 may instead be stored in memory 145.

Electronic media device 100 may also include input component 120 and output component 125 for providing a user with the ability to interact with electronic media device 100. For example, input component 120 and output component 125 may provide an interface for a user to interact with an application running on control circuitry 130. Input component 120 may take a variety of forms, such as a keyboard/keypad, trackpad, mouse, click wheel, button, stylus or touch screen. Input component 120 may also include one or more devices for user authentication (e.g., smart card reader, fingerprint reader or iris scanner) as well as an audio input device (e.g., a microphone) or a video input device (e.g., a camera or a web cam) for recording video or still frames. Output component 125 may include any suitable display, such as a liquid crystal display (LCD) or a touch screen display, a projection device, a speaker or any other suitable system for presenting information or media to a user. Output component 125 may be controlled by graphics circuitry 135. Graphics circuitry 135 may include a video card, such as a video card with 2D, 3D or vector graphics capabilities. In some embodiments, output component 125 may also include an audio component that is remotely coupled to electronic media device 100. For example, output component 125 may include a headset, headphones or ear buds that may be coupled to electronic media device 100 with a wire or wirelessly (e.g., Bluetooth headphones or a Bluetooth headset).

Electronic media device 100 may have one or more applications (e.g., software applications) stored on storage device 150 or in memory 145. Control circuitry 130 may be configured to execute instructions of the applications from memory 145. For example, control circuitry 130 may be configured to execute a media player application that causes full-motion video or audio to be presented or displayed on output component 125. Other applications resident on electronic media device 100 may include, for example, a telephony application, a GPS navigator application, a web browser application and a calendar or organizer application. Electronic media device 100 may also execute any suitable operating system, such as a Mac OS, Apple iOS, Linux or Windows and can include a set of applications stored on storage device 150 or memory 145 that is compatible with the particular operating system.

In some embodiments, electronic media device 100 may also include communications circuitry 155 to connect to one or more communications networks. Communications circuitry 155 may be any suitable communications circuitry operative to connect to a communications network and to transmit communications (e.g., voice or data) from electronic media device 100 to other devices within the communications network. Communications circuitry 155 may be operative to interface with the communications network using any suitable communications protocol such as, for example, Wi-Fi (e.g., a 802.11 protocol), Bluetooth, high frequency systems (e.g., 900 MHz, 2.4 GHz and 5.6 GHz communication systems), infrared, GSM, GSM plus EDGE, CDMA, quadband and other cellular protocols, VOIP or any other suitable protocol.

In some embodiments, communications circuitry 155 may be operative to create a communications network using any suitable communications protocol. Communications circuitry 155 may create a short-range communications network using a short-range communications protocol to connect to other devices. For example, communications circuitry 155 may be operative to create a local communications network using the Bluetooth protocol to couple with a Bluetooth headset (or any other Bluetooth device). Communications circuitry 155 may also include a wired or wireless network interface card (NIC) configured to connect to the Internet or any other public or private network. For example, electronic media device 100 may be configured to connect to the Internet via a wireless network, such as a packet radio network, an RF network, a cellular network or any other suitable type of network. Communication circuitry 145 may be used to initiate and conduct communications with other communications devices or media devices within a communications network.

Electronic media device 100 may also include any other component suitable for performing a communications operation. For example, electronic media device 100 may include a power supply, an antenna, ports or interfaces for coupling to a host device, a secondary input mechanism (e.g., an ON/OFF switch) or any other suitable component.

Electronic media device 100 may also include POM sensors 160. POM sensors 160 may be used to determine the approximate geographical or physical location of electronic media device 100. As described in more detail below, the location of electronic media device 100 may be derived from any suitable trilateration or triangulation technique, in which case POM sensors 160 may include an RF triangulation detector or sensor or any other location circuitry configured to determine the location of electronic media device 100.

POM sensors 160 may also include one or more sensors or circuitry for detecting the position orientation or movement of electronic media device 100. Such sensors and circuitry may include, for example, single-axis or multi-axis accelerometers, angular rate or inertial sensors (e.g., optical gyroscopes, vibrating gyroscopes, gas rate gyroscopes or ring gyroscopes), magnetometers (e.g., scalar or vector magnetometers), ambient light sensors, proximity sensors, motion sensor (e.g., a passive infrared (PIR) sensor, active ultrasonic sensor or active microwave sensor) and linear velocity sensors. For example, control circuitry 130 may be configured to read data from one or more of POM sensors 160 in order to determine the location orientation or velocity of electronic media device 100. One or more of POM sensors 160 may be positioned near output component 125 (e.g., above, below or on either side of the display screen of electronic media device 100).

Figure 4:
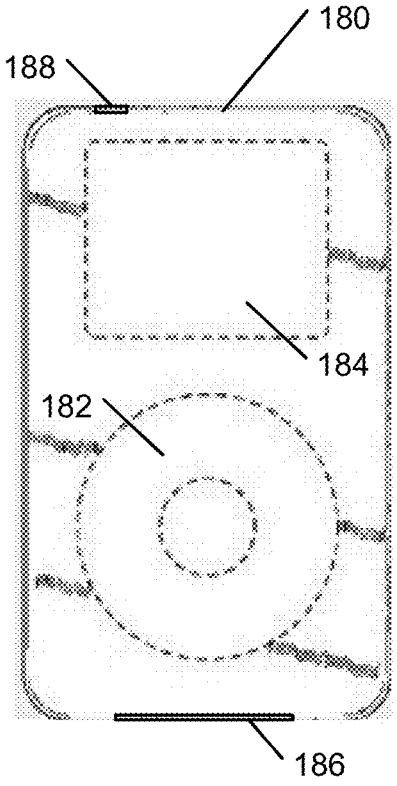
FIG. 4 depicts an illustrative rendering of one particular embodiment of an electronic media device suitable for use with embodiments of the present invention.

FIG. 4 depicts an illustrative rendering of one particular electronic media device 180. Device 180 includes a click wheel 182 as an input component and an LED display 184 as an output component. Device 180 also includes connector receptacle 186 and audio plug receptacle 188. For simplicity, various internal components, such as the control circuitry, graphics circuitry, bus, memory, storage device and other components are not shown in FIG. 4.

Figure 5A:
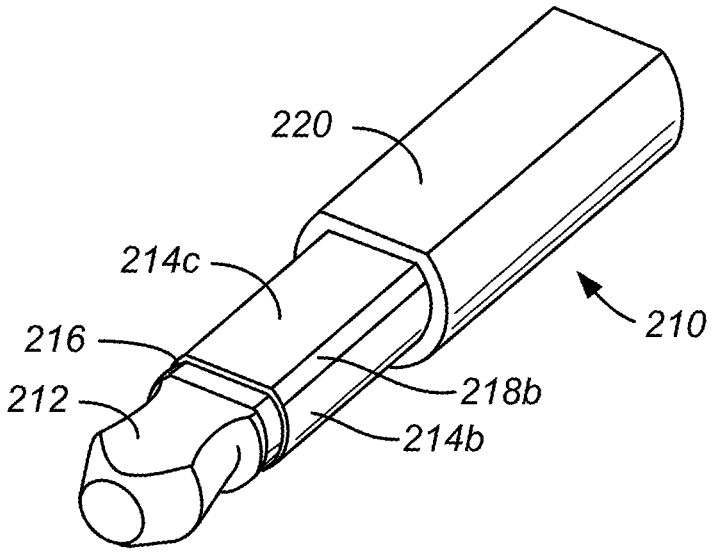
FIGS. 5A-5C are simplified perspective and side views of a D-shaped plug connector according to one embodiment of the present invention.
Figure 5B:
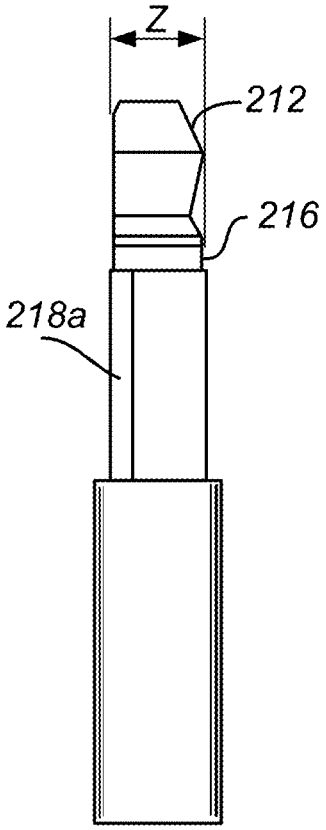
Figure 5C:
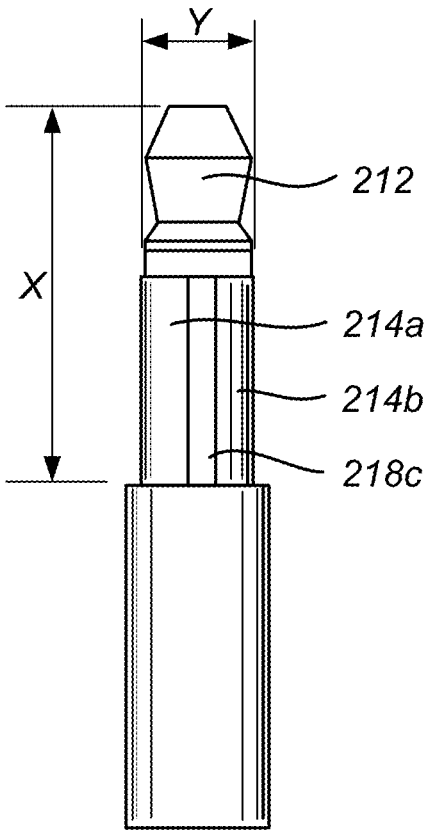

In one particular embodiment, the present invention pertains to connectors that have a single insertion orientation. As an example, FIGS. 5A-5C illustrate a D-shaped plug connector 210 that has a ground contact 212 at its tip and three contacts 214*a* (left audio), 214*b* (right audio) and 214*c* (microphone) that are separated from the tip by an insulation ring 216 and extend along the length of the connector from insulation ring 216 to its base. Contacts that extend along the length of the connector from insulation ring 216 to its base are also referred to as axial contacts. Additional insulation strips 218*a*, 218*b* and 218*c* separate contacts 214*a*-214*c* from each other. The flat surface, upon which contact 214*c* if formed, acts as a keyed feature of connector 210, which when aligned with a matching flat surface of a corresponding receptacle connector (shown in FIGS. 7A and 7B) having a matching D-shaped cavity, ensures that plug connector 210 only can be inserted into the connector jack in a single orientation thus aligning each of the contacts 214*a*-214*c* with respective contacts in the receptacle connector. As shown in FIG. 5A-5C, contacts 214*a* and 214*b* may be curved and formed on a curved surface, while contact 214*c* may be flat and formed on a flat surface. The lengths of contacts 214*a*-214*c* may be longer than their widths.

In other embodiments, contacts do not extend along the full length of the connector from insulation ring 216 to its base. For example, contacts 214*a* (left audio), 214*b* (right audio) and 214*c* (microphone) may run only a half, a third, a fourth, or another suitable portion of the length of the connector, from the insulation ring to its base. In some embodiments, the ends of the axial contacts may be equidistant from the insulation ring and the base of the connector or shell. In some embodiments, the ends of the axial contacts may not be equidistant from the insulation ring and the base of the connector or shell. In some embodiments, contacts have a different length and are positioned differently between the insulation ring and the base of the connector as compared to at least one other contact.

In one particular embodiment, connector 210 has an insertion length, X, of about 8 mm; a diameter, Y, of about 2.4 mm; a height, Z, of about 2.0 mm and a volume of about 29.1 $mm^3$.

The geometry of the insertion portion or sleeve of connector 210 may be selected to create a press fit plug and jack interface that requires specific insertion and extraction forces such that the retention force required to insert connector 210 into a matching connector jack (shown in FIGS. 7A and 7B) is higher than the extraction force required to remove the plug connector from the jack. Aside from thickness, Z, the dimensions of connector 210 may be similar to that of the standard audio connector (TRS and TRRS) mentioned above in the "Background of the Invention" section.

In some embodiments, the width of the contacts, insulation strips and rings, and other elements of connector 210 may be varied as compared to the relative widths illustrated in FIGS. 5A-5C.

In one embodiment, connector 210 is made exclusively or primarily from rigid and relatively inflexible materials. Contacts 212, 214*a*-214*c* can be made from a copper, nickel, brass, a metal alloy or any other appropriate conductive material. Thermoplastic polymer or similar material to provide strain relief and insulation, e.g., POM, may be injected around the contacts to create the insulation ring 216 and insulation strips 218*a*, 218*b* and 218*c*. An ABS or similar material can be used to create shell 220, which is positioned over and fastened to the base of the connector as shown in FIG. 5A. In some embodiments, Shell 220 may be thicker than the sleeve, i.e., the dimensions of shell 220 may be greater than diameter, Y, and height, Z.

Figure 6A:
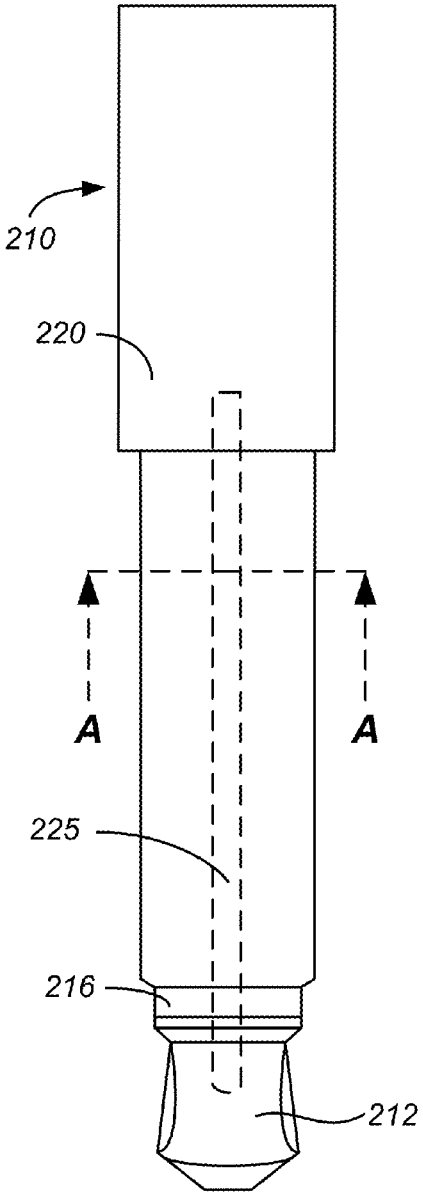
Figure 6B:
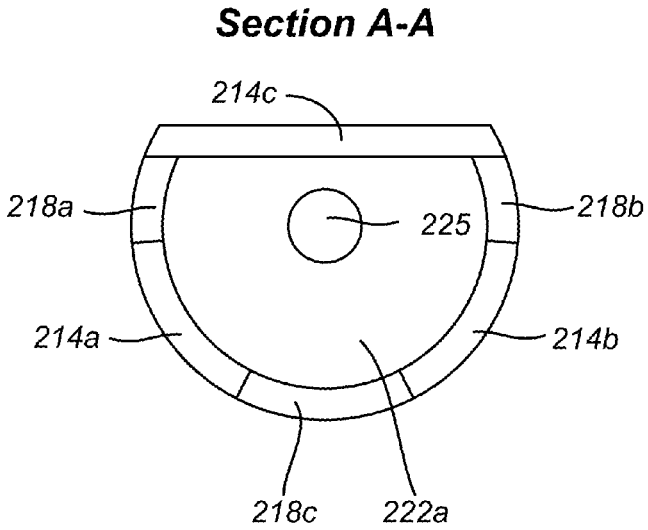
FIGS. 6B and 6C are simplified cross-sectional views of particular embodiments of the D-shaped connector shown in FIG. 6A.
Figure 6C:
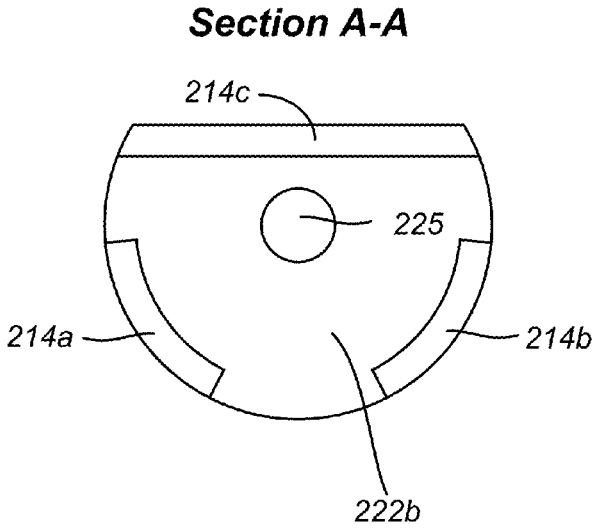

In another embodiment, connector 210 includes a flexible inner member that gives connector 210 increased flexibility, allowing it to deform in order to prevent breakage. Additional advantages provided by the inclusion of a flexible inner member may include increased ease of insertion for the user as there would be more leeway in the insertion orientation required to successfully insert the connector into a corresponding connector receptacle. FIG. 6A is top view of the D-shaped connector according to embodiments of the invention wherein a flexible inner member is included while FIGS. 6B and 6C are simplified cross-sectional views of particular embodiments of the D-shaped connector shown in FIG. 6A. In addition to providing a top view of connector 210, FIG. 6A also shows an internal element, namely flexible inner member 225. Flexible inner member 225 may be made out of a flexible material, such as nitinol, coated with a conductive layer to carry the ground signal that extends along at least a portion of the length of the connector. The flexible inner member 225 may be a circular rod, may have a D-shaped cross-section or other appropriate shapes. In some embodiments, contacts 214*a*-214*c* (shown in FIGS. 5A and 5B) can be brass or other metal contacts formed on flexible elastomer 222*a* so that each axial section serves as a bending plate allowing connector 210 to bend in order to relieve stress when the connector is inserted or extracted off-axis. Flexible elastomer 222*a* may be polypropylene or polyoxymethylene which is injection molded to capture and insulate components, e.g., contacts 214*a*-214*c* (shown in FIGS. 5A and 5B). In another embodiment, contacts 214*a*-214*c* (shown in FIGS. 5A and 5B) and dielectric material may all be part of a flex circuit that is slid over flexible inner element 225. This arrangement allows connector 210 to flex relatively evenly along much of its length. Also, insulation strips 218*a*-218*c* (shown in FIGS. 5A and 5B) may be made from a flexible elastomer and contacts 214*a*-214*c* (shown in FIGS. 5A and 5B) may be flex circuits that are adhered to flexible inner member 225 or adhered to elastomer that is injection molded around the inner member. The shell 220 (shown in FIGS. 5A and 5B) of connector 210 can be overmolded with a thermoplastic elastomer to give it elastic properties as well.

In one particular embodiment, flexible inner member 225 is a sheet of superelastic material, such as nitinol (an alloy of nickel and titanium present in roughly equal amounts) and the flexible contacts are part of a flex circuit adhered to the superelastic sheet. Nitinol alloys exhibit elasticity some 10-30 times that of ordinary metal which enables it to flex under very high strain without breaking. The flex circuit may include, for example, metal contacts 214*a*-214*c* screen printed on a thin polymide or PEEK (polyether ether ketone) layer. The flex circuit may be made from two separate pieces each of which is directly adhered to one side of the nitinol sheet or may be a single piece wrapped around the perimeter of the nitinol sheet or made into a sleeve that fits over the nitinol sheet.

The invention is not limited to the use of any particular superelastic material and can instead use any material that deforms reversibly to very high strains and returns to its original shape when the load is removed without requiring a change of temperature to regain its original shape. Also, some embodiments of the invention may use flexible materials for flexible inner member 225 that are not superelastic. For example, flexible inner member 225 can be made from an elastomer or polyurethane in some embodiments.

In another embodiment contacts 214*a*-214*c* (shown in FIGS. 5A and 5B) can be surrounded by flexible elastomer 222*b* so that each axial section serves as a bending plate allowing connector 210 to bend in order to relieve stress when the connector is inserted or extracted off-axis. Flexible elastomer 222*b* may be polypropylene or polyoxymethylene which is injection molded to capture and insulated components, e.g., contacts 214*a*-214*c* (shown in FIGS. 5A and 5B). In these embodiments, flexible elastomer 222*b* replaces the need for insulation strips 218*a*-218*c*. In order to injection mold flexible elastomer 222*b* where insulation strips are not present, contacts 214*a*-214*c* (shown in FIGS. 5A and 5B) may be positioned in a frame or mold until flexible elastomer 222*b* is injection molded around the contacts. Thus, elastomer 222*b* may provide structural support as well as to capture and insulate components, e.g., contacts 214*a*-214*c* (shown in FIGS. 5A and 5B). In these embodiments, as well as previously mentioned embodiments employing injection molding, vacuum injection molding may be used and may minimize trapped air or gases that may lead to defective connectors.

In some embodiments, when connector plug 210 is engaged with a corresponding receptacle connector (shown in FIG. 7B) and extracted at an angle to the insertion axis, more force is applied to the base of the connector than at its tip. To address this discrepancy, in some embodiments the flexibility of flexible inner member 225 varies along the length of the member so that, for example, it is more flexible near the base portion or proximal end of the connector and less flexible near the distal end of the connector. Flexibility can be varied in this manner by, among other techniques, varying the materials along the length of the connector, varying the thickness of flexible inner member 225 along its length or varying the shape of flexible inner member 225 along its length or any combination of these approaches. For example, in one embodiment flexible inner member 225 may include a superelastic sheet near its base and a polyurethane sheet near its distal end. The superelastic and polyurethane sheets may overlap and be adhered together in an area between the proximal and distal ends. In one particular embodiment, flexible inner member 225 includes two sheets of polyurethane near the distal end of connector 210 and a single sheet of nitinol near the base of connector 210. At a point approximately one third of the length of the connector from the distal end, the nitinol sheet is sandwiched between the two polyurethane sheets for a portion of the length.

In other embodiments, connector 210 may not only have variable flexibility about its length, but it may also alternate between rigid and flexible throughout its length in a myriad of combinations. For example, a hybrid rigid-flexible connector may be implemented in some circumstances.

Figure 7A:
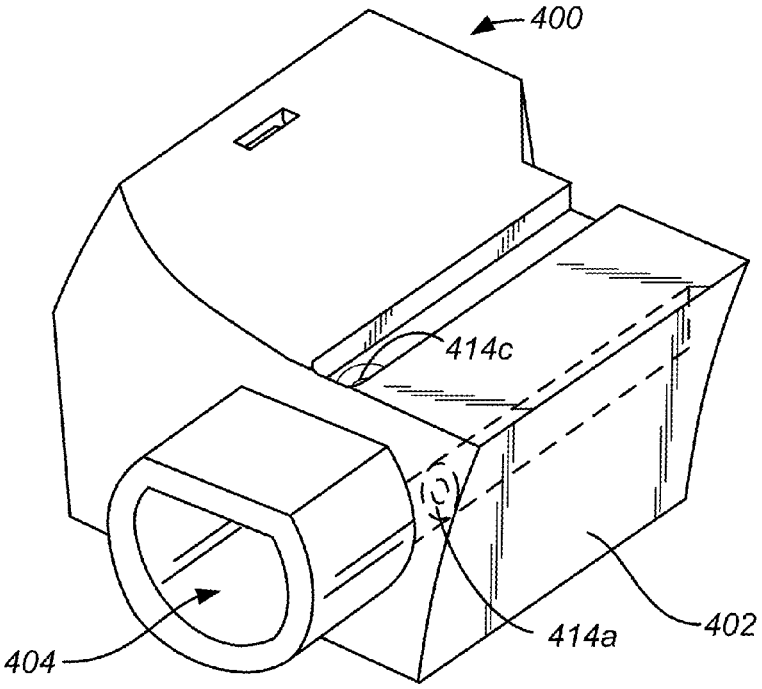
Figure 7B:
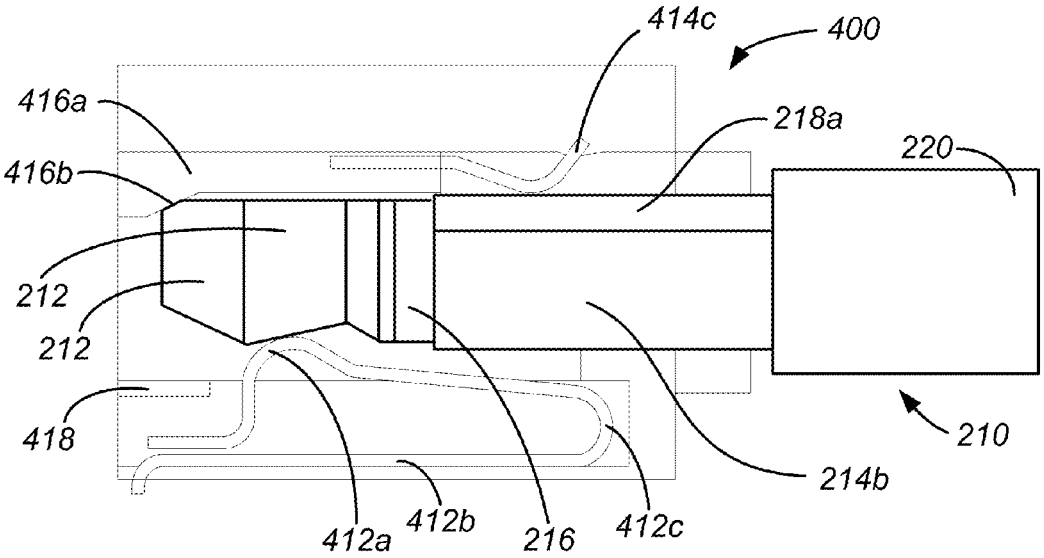
FIG. 7B is a cross-sectional view of the connector jack shown in FIG. 7A and a side view of a complementary plug mated with the connector jack.

In some embodiments, connector 210 is designed to break when side-loaded at a certain tension after it is inserted into a matching connector jack (shown in FIGS. 7A and 7B). It is preferable that connector 210 breaks as opposed to the connector jack because if the connector jack breaks, the electronic device in which it is housed may no longer be usable. To this end, in some embodiments, plug connectors according to the present invention are made from flexible materials such as elastomers or polymide dielectric materials to reduce strain when side-loaded under high levels of force and the like. As an example, when fully inserted, a rigid portion and a portion of a flexible portion of connector 210 may be inserted within a matching connector jack (shown in FIGS. 7A and 7B). When connector 210 is extracted from a matching connector jack (shown in FIGS. 7A and 7B) with a force that intersects its insertion axis, connector 210 bends or deforms the flexible portion which reduces the risk the connector will bind within or break the connector jack (shown in FIGS. 7A and 7B).

FIG. 7A is a simplified perspective view of a matching connector jack (connector receptacle) 400 according to embodiments of the invention. FIG. 7A illustrates connector jack 400 according to the present invention including a housing 402 that defines an interior cavity 404 into which a plug connector, such as connector 210, can be inserted. Also shown in FIG. 7A are contacts 414*c* and 414*a* that may be electrically coupled to corresponding contacts 214*c* and 214*b* (shown in FIGS. 5A-5C). Connector jack 400 aligns axial contact 214*c* with overhead contact 414*c* as illustrated in FIG. 7A, allowing connector 210 to be operatively coupled to connector jack 400. Similar connector jack contacts may be implemented for the other contacts of connector 210, e.g., contact 214*b* may have a corresponding contact on connector jack 400—similar to the contact 414*a*.

FIG. 7B is a cross-sectional view of the jack connector of FIG. 7A and a side view of a complementary plug to mate with jack connector 400. FIG. 7B illustrates connector 210 inserted in connector jack 400 according to one embodiment of the present invention. Also shown are contact 414*c* and contact portion 412*a* of movable ground contact 412*b* which engage corresponding contact 214*c* and ground contact 212. Similar corresponding contacts may exist for contacts 214*a* and 214*b*. The rear element 416*a* forms an angled face 416*b* at an angle corresponding to that of the oblique face of ground contact 212 so that when the connector 210 is fully inserted into the jack connector 400, the oblique face of ground contact 212 is flush with angled face 416*b*.

In some embodiments, connector 210 may have a retention feature that holds it firmly in place when fully inserted within corresponding connector jack 400. The retention feature may be mechanical or magnetic.

In an example of a mechanical embodiment, movable ground contact 412*b* may initially be held by stopping element 418 in a position wherein spring element 412*c* of movable ground contact 412*b* only is partially compressed. When connector 210 is inserted with sufficient force to further compress spring element 412*c*, it may further compress movable ground contact 412*b* into the position shown in FIG. 7B; this allows full insertion of connector 210 and provides a retention force as connector 210 is pressed against angled face 416*b* by the spring portion 412*c* of movable ground contact 412*b*. This retention force provides the retention feature. Connector 210 may be extracted from connect jack 400 when sufficient extraction force is applied to connector 210 to compress spring element 412*c*.

In one example of a magnetic connector system, each of the plug connector and receptacle connector have a magnetic element. A magnetic element in the plug connector may be attracted to a magnetic element in the receptacle connector such that the plug connector may be magnetically held in place when mated with the receptacle. In a specific example, magnets in the receptacle may be arranged in proximity to each other with opposing polarities. With this arrangement, field lines originating in one magnet in the receptacle connector may pass through the ferromagnetic element in the plug connector and terminate in another magnet in the receptacle. Mechanical retention systems may also be used which may implement a cantilevered spring or detent to hold the connector plug in place.

FIGS. 7A and 7B also illustrate the space saving feature of the D-shaped connector implementation, wherein an electronic device may be made slimmer or have additional internal components by virtue of the D-shaped connector's smaller thickness.

Figure 8A:
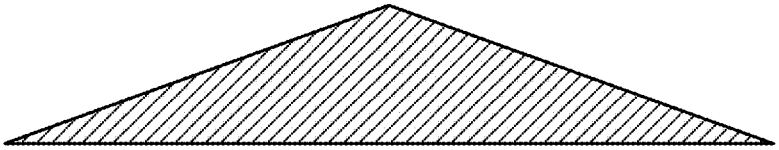
FIGS. 8A-8C are simplified cross-sectional views of connector plugs according to embodiments of the invention.
Figure 8B:
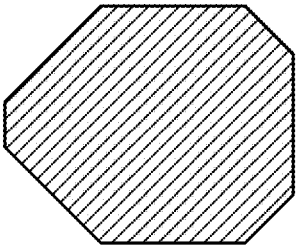
Figure 8C:
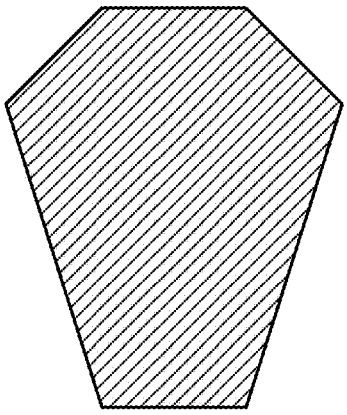

In other embodiments of the invention, the connector plug may have a differently shaped cross-section. FIGS. 8A-8C are simplified cross-sectional views of connector plugs according to embodiments of the invention. The cross-section of the connector plug may be shaped like a non-regular polygon (non-equilateral and non-equiangular polygon), including a non-equilateral triangle (shown in FIG. 8A), a non-regular octagon (shown in FIG. 8B), a non-regular hexagon (shown in FIG. 8C) or other shapes wherein a plurality of axial contacts and a plurality of axial insulation strips may be integrated. An inherent feature of a connector plug with a non-regular polygon cross section is that it will have a single insertion orientation when mated with a receptacle connector having a matching cavity. In other words, these embodiments may be described in terms of whether the cross-section of the connector plug has rotational symmetry—a cross section that looks the same after rotating the orientation of the cross-section less than 360 degrees in any direction. In embodiments of the invention, the cross-section of the connector plug does not have rotational symmetry. Connector plug with axial contacts have a required insertion orientation that may be dependent on the positions of the contacts. Thus, the connector plug (specifically its cross section) may be designed to only have one insertion rotation compatible with the shape of the connector receptacle in order for the contacts to be able to mate properly without additional design modifications.

As will be understood by those skilled in the art, the present invention may be embodied in other specific forms without departing from the essential characteristics thereof. For example, while embodiments of the invention were discussed above with respect to audio plugs having four contacts, the invention is not limited to any particular number of contacts. Some embodiments of the invention may have as few as two contacts while other embodiments can have thirty or even more contacts. As one example of a variation with additional contacts, an additional insulation ring may be implemented so as to split each of the contacts 214*a*, 214*b* and 214*c* into halves, thereby doubling the number of contacts. In other embodiments, the location of the contacts, insulation strips, insulation rings, and grounds may be interchangeable—creating additional variations of the present invention.

Additionally, while the invention was described with respect to an audio connector, it is not limited to any particular type of signal and can be used to carry video and/or other signals instead of audio-related signals or in addition to audio-related signals. Also, in some embodiments, connectors according to the present invention can carry both analog and digital signals. As an example, connector 210 and its flexible version can be modified to include one or more fiber optic cables that extend through the connector and can be operatively coupled to receive or transmit optical signals between a mating connector jack. Those skilled in the art will recognize, or be able to ascertain, using no more than routine experimentation, many equivalents to the specific embodiments of the invention described herein. Such equivalents are intended to be encompassed by the following claims.

What is claimed is:

1. A plug connector comprising:

a shell;

a sleeve coupled to the shell at its base and having a D-shaped cross section, the sleeve having a ground contact at its distal tip, a plurality of external contacts arranged around a periphery of the sleeve, a plurality of dielectric strips that electrically isolate the plurality of contacts from each other and an insulation ring between the distal tip and the plurality of contacts and plurality of dielectric strips; wherein each of the plurality of contacts and plurality of dielectric strips extend from the insulation ring to the shell.

2. The plug connector of claim 1 wherein the plurality of external contacts comprise three contacts: a left audio contact, a right audio contact and a microphone contact.

3. The plug connector of claim 2 wherein the microphone contact is formed on a flat surface of the sleeve.

4. The plug connector of claim 2 wherein the left audio contact and the right audio contact are formed on a curved surface of the sleeve.

5. The plug connector of claim 1 wherein the plurality of external contacts have a length which is greater than a width of the plurality of external contacts.

6. The plug connector of claim 1 wherein the sleeve has an outer diameter of about 2.4 mm and an insertion depth of about 8 mm.

7. The plug connector of claim 1 wherein at least one of the plurality of external contacts have a width that is different than at least another of the plurality of external contacts.

8. The plug connector of claim 1 wherein the insulation strips are integrally formed.

9. The plug connector of claim 1 wherein the sleeve has another insulation ring which divides at least one of the plurality of external contacts into two separate contacts.

10. A plug connector comprising:

a shell;

a sleeve coupled to the shell at its base and having a D-shaped cross section, the sleeve having a ground contact at its distal tip, a plurality of external contacts arranged around a periphery of the sleeve, a plurality of flexible dielectric strips that electrically isolate the plurality of contacts from each other and an insulation ring between the distal tip and the plurality of contacts and plurality of dielectric strips; wherein each of the plurality of contacts and plurality of dielectric strips extend from the insulation ring to the shell.

11. The plug connector set forth in claim 10 wherein the plurality of external contacts arranged around the periphery of the sleeve are formed on a flex circuit adhered to the sleeve.

12. The plug connector set forth in claim 10 further comprising an inner flexible member traversing a length of the sleeve between the distal end and the shell.

13. The plug connector set forth in claim 10 wherein the flexibility of the sleeve changes between its distal and proximal ends.

14. The plug connector of claim 10 wherein the plurality of external contacts comprise three contacts: a left audio contact, a right audio contact and a microphone contact.

15. The plug connector of claim 10 wherein the sleeve has an outer diameter of about 2.4 mm and an insertion depth of about 8 mm.

16. A plug connector comprising:

a shell;

a sleeve coupled to the shell at its base and having a non-regular polygon cross section, the sleeve having a ground contact at its distal tip and a plurality of external axial contacts that extend from the ground contact to the shell, wherein each of the axial contacts are separated by a dielectric material.

17. The plug connector set forth in claim 16 wherein the shell is flexible.

18. The plug connector set forth in claim 16 wherein the dielectric material is flexible.

19. The plug connector set forth in claim 16 further comprising a flexible inner member traversing a length of the connector between the distal end and the shell, wherein the external axial contacts and dielectric material surround the flexible inner member.

20. The plug connector set forth in claim 19 wherein the flexible inner member comprises a flexible rod.

21. The plug connector set forth in claim 16 wherein the flexibility of the shell and the sleeve changes between a distal end and a proximal end of the plug connector.

22. The plug connector of claim 16 wherein the plurality of external contacts comprise three contacts: a left audio contact, a right audio contact and a microphone contact.

* * * * *